United States Patent [19]

Edmonston

[11] 4,013,741

[45] Mar. 22, 1977

[54] CARBURETOR

[75] Inventor: William H. Edmonston, Lake Isabella, Calif.

[73] Assignee: Lectron Products, Inc., Troy, Mich.

[22] Filed: May 30, 1975

[21] Appl. No.: 582,430

Related U.S. Application Data

[63] Continuation-in-part of Ser. No. 563,594, March 31, 1975.

[52] U.S. Cl. ..... 261/44 R; 261/39 D; 251/DIG. 4

[51] Int. Cl.[2] ..... F02M 9/06

[58] Field of Search ..... 261/44 R, 50 A, DIG. 38, 261/39 D; 251/DIG. 4

[56] References Cited

UNITED STATES PATENTS

| | | | |
|---|---|---|---|
| 1,375,898 | 4/1921 | Ciglia et al. | 261/44 R |
| 1,421,627 | 7/1922 | Waterhouse | 261/44 R |
| 2,987,304 | 6/1961 | Roy | 261/44 R |
| 3,198,498 | 8/1965 | Mennesson | 261/50 A |
| 3,246,886 | 4/1966 | Goodyear et al. | 261/39 D |
| 3,351,327 | 11/1967 | Simonet et al. | 261/50 A |
| 3,752,454 | 8/1973 | Korponay | 261/44 R |

FOREIGN PATENTS OR APPLICATIONS

| | | | |
|---|---|---|---|
| 152,442 | 10/1920 | United Kingdom | 261/44 R |

*Primary Examiner*—Tim R. Niles
*Attorney, Agent, or Firm*—Harness, Dickey & Pierce

[57] ABSTRACT

A carburetor of the slide and pin type having a throttle slide mounted in grooves on opposite sides of the throat and carrying a pin extending into a fuel discharge nozzle tube. The control edge of the slide has a concave recess which, together with the confronting surface of the carburetor throat defines the air passage surrounding the pin and concentrates the flow of air directly over and past the pin in such a way as to thoroughly atomize the fuel and distribute it uniformly in the airstream. Another feature of the invention is a choke arrangement comprising a longitudinal air passage bypassing the throttle slide and leading to a fuel choke valve and a cross passage into the downstream portion of the carburetor throat. The air flow through this passage will draw fuel up through the valve.

6 Claims, 6 Drawing Figures

FIG. 4.
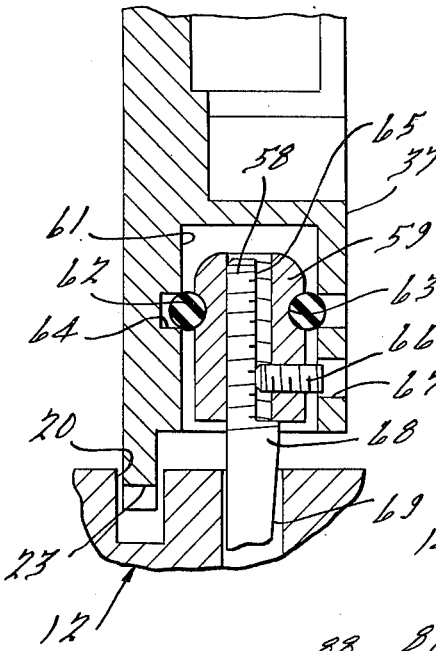
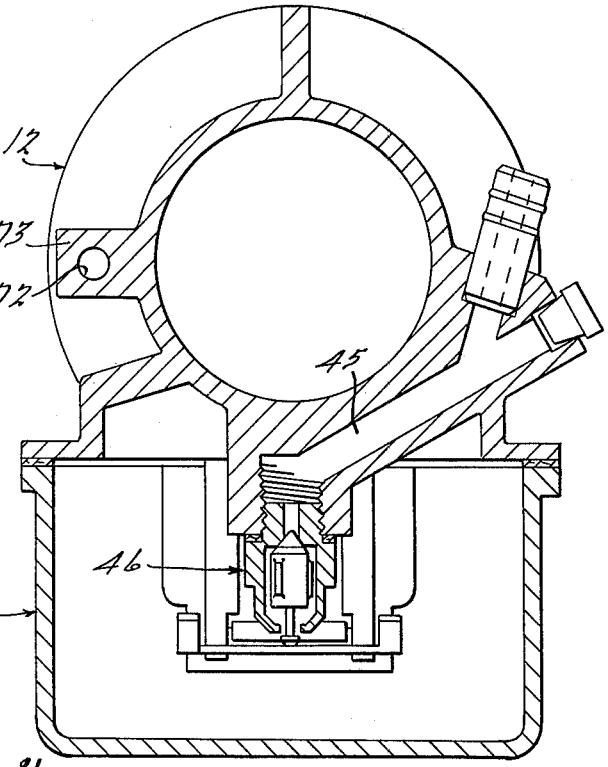
FIG. 5.
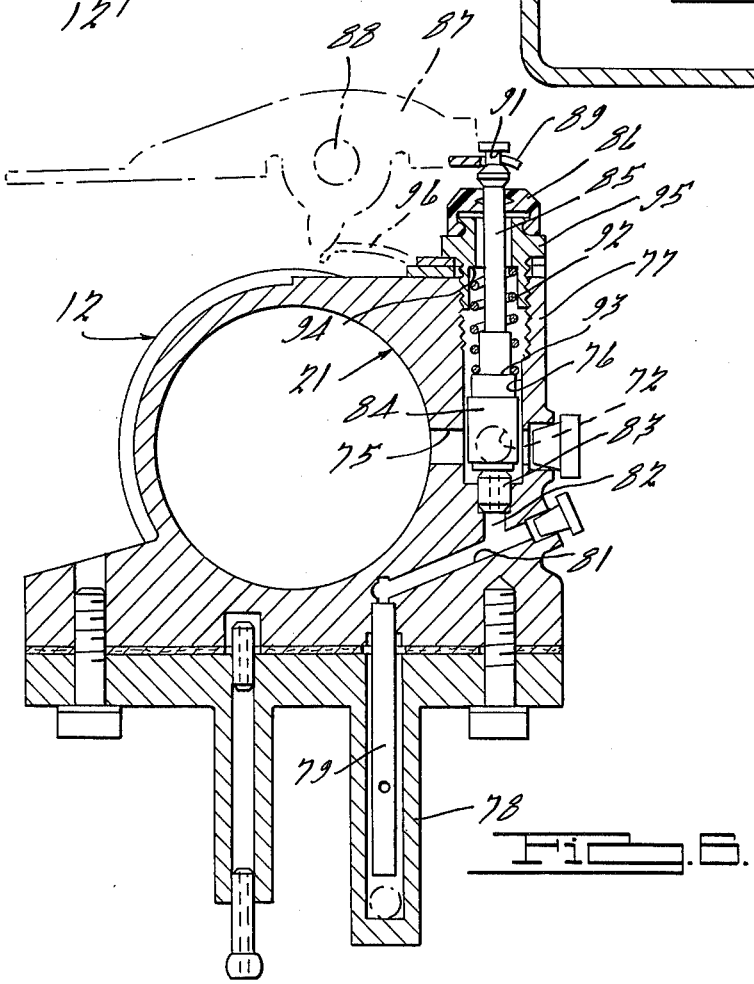
FIG. 6.

CARBURETOR

This application is a continuation-in-part of application Ser. No. 563,594, filed Mar. 31, 1975 and entitled "Carburetor."

BACKGROUND OF THE INVENTION

The invention relates to carburetor constructions, and more particularly to carburetors of the type having a through passage for air and an adjustable throttle slide at an intermediate position which varies the flow-through area and simultaneously adjusts the amount of fuel which enters the passage at that intermediate point and is mixed with the flowing air. More particularly, the invention is concerned with the construction of the slide and its coaction with the nozzle means to achieve thorough atomization of the fuel. The invention is also concerned with a choke arrangement for the carburetor.

BRIEF SUMMARY OF THE INVENTION

It is an object of the present invention to provide a novel and improved carburetor of the slide and pin type which assures thorough atomization and distribution of the fuel in the airstream before it reaches the combustion chamber, and minimizes the possibility of fuel droplets leaving the airstream and condensing on the wall of the fuel passage.

It is a further object to provide an improved carburetor construction of this type which, at all settings, maximizes the flow of air in the vicinity of the pin to achieve the optimum effect in drawing fuel into the airstream.

It is another object to provide an improved carburetor construction of this type which has a novel choke arrangement which will allow extra fuel to be atomized and enter the carburetor throat when desired.

Briefly, the invention comprises a carburetor having a body with inlet and outlet ends, a throat extending through said body from one end to the other, a throttle slide in said body extending transversely to the throat at an intermediate portion thereof, said slide being movable to vary the unblocked portion of said throat, a fuel tube extending transversely to said throat and having an opening into the throat, a pin disposed in said tube and being tapered with the widest portion of the taper adjacent said opening, means mounting the end of said pin adjacent said widest portion of the taper on said slide, a controlling edge on said slide which, together with the confronting surface of the carburetor throat, defines a passage, and a concave recess on said edge concentric with said pin.

In another aspect, the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, a longitudinal passage in said body leading from said inlet end past and slide, a cross passage leading from said longitudinal passage into said throat downstream of said slide, a fuel passage leading to the juncture of said longitudinal and cross passages, and a choke valve in said fuel passage whereby, upon opening of said valve, air flowing through said air passages will draw fuel through said fuel passage.

BRIEF DESCRIPTION OF THE DRAWINGS

FIG. 4 is an enlarged fragmentary cross-sectional view of a portion of the slide, showing the mounting means for the pin;

FIG. 5 is a cross-sectional view in elevation taken along the line 5—5 of FIG. 1 and showing the choke passage; and FIG. 6 is a cross-sectional view in elevation taken along the line 6—6 of FIG. 1 and showing the choke valve.

DESCRIPTION OF THE PREFERRED EMBODIMENTS

Figure 1:
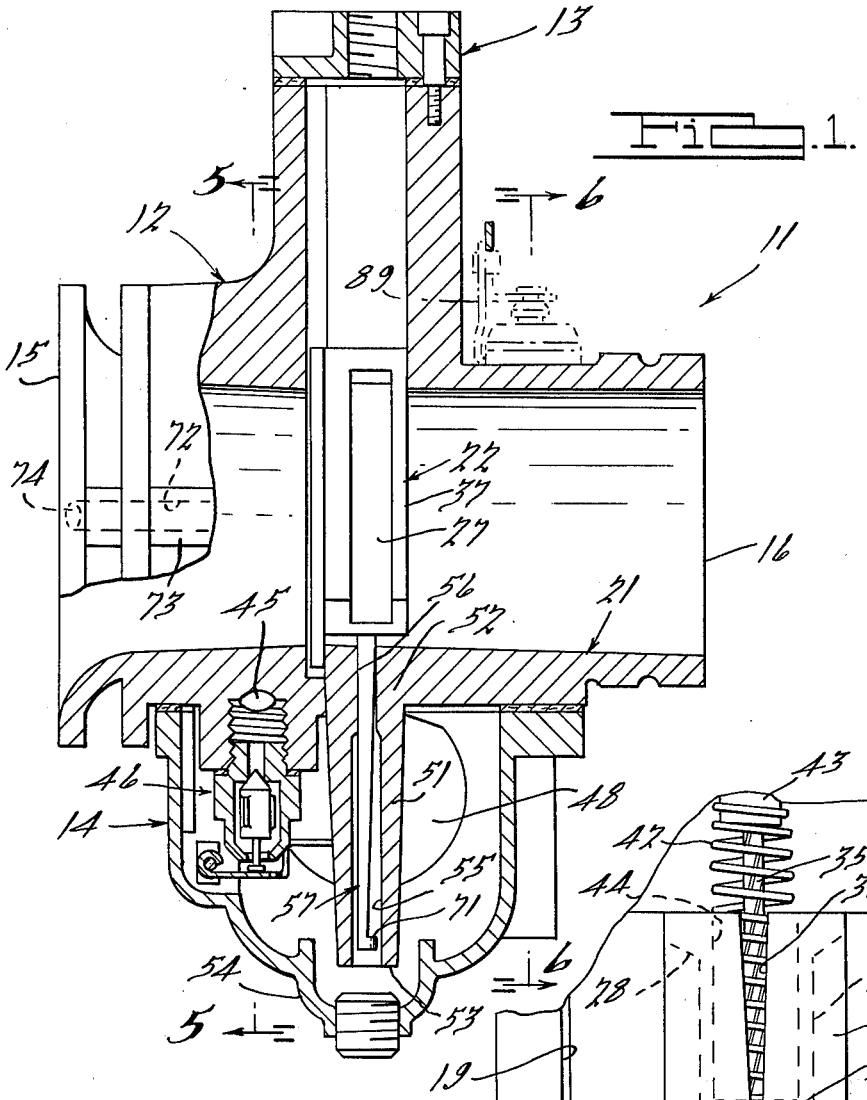
FIG. 1 is a side elevational view, partly sectioned, of the carburetor of this invention showing the carburetor throat, slide and bowl.
Figure 3:
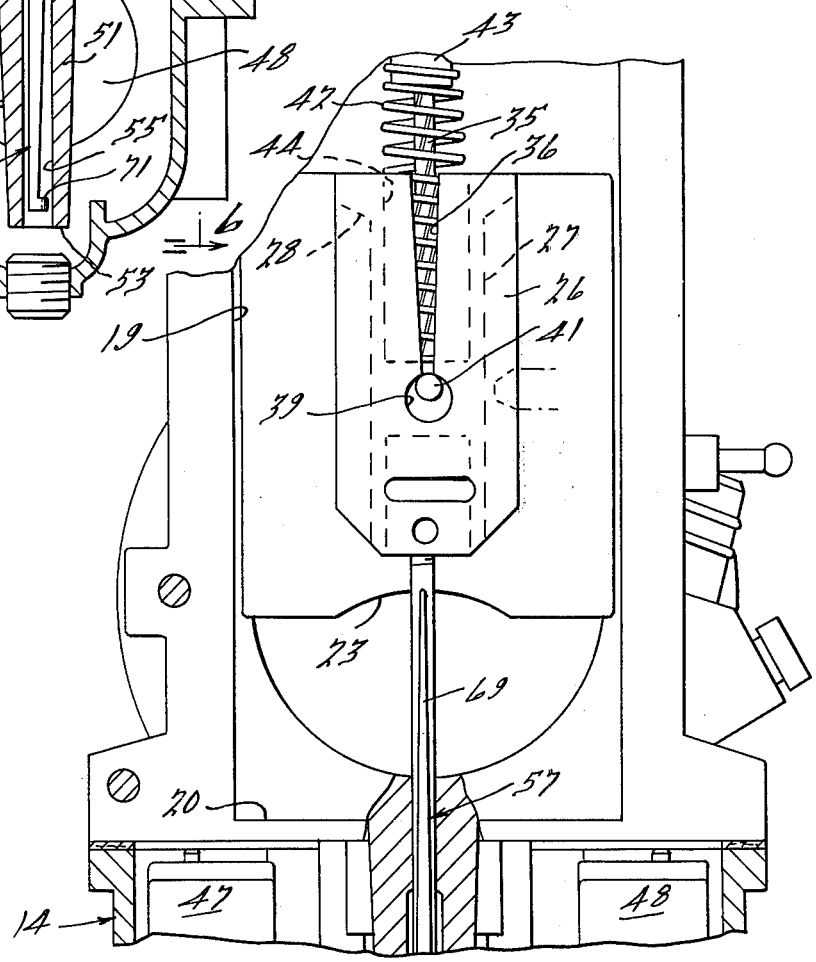
FIG. 3 is a fragmentary view similar to FIG. 2 but showing the slide in an open position.

The carburetor is generally indicated at 11 and comprises a body generally indicated at 12, a cover generally indicated at 13 above the body, and a bowl generally indicated at 14 secured to the underside of the body. Body 12 is of elongated shape, having an air inlet end 15 and an outlet end 16, both ends being open. A slide supporting portion generally indicated at 17 is formed on body 12 intermediate ends 15 and 16 and extends thereabove. Suitably, body 12 may be fabricated of two parts having abutting surfaces at slide supporting portion 17, these parts being united by fasteners 18.

Figure 2:
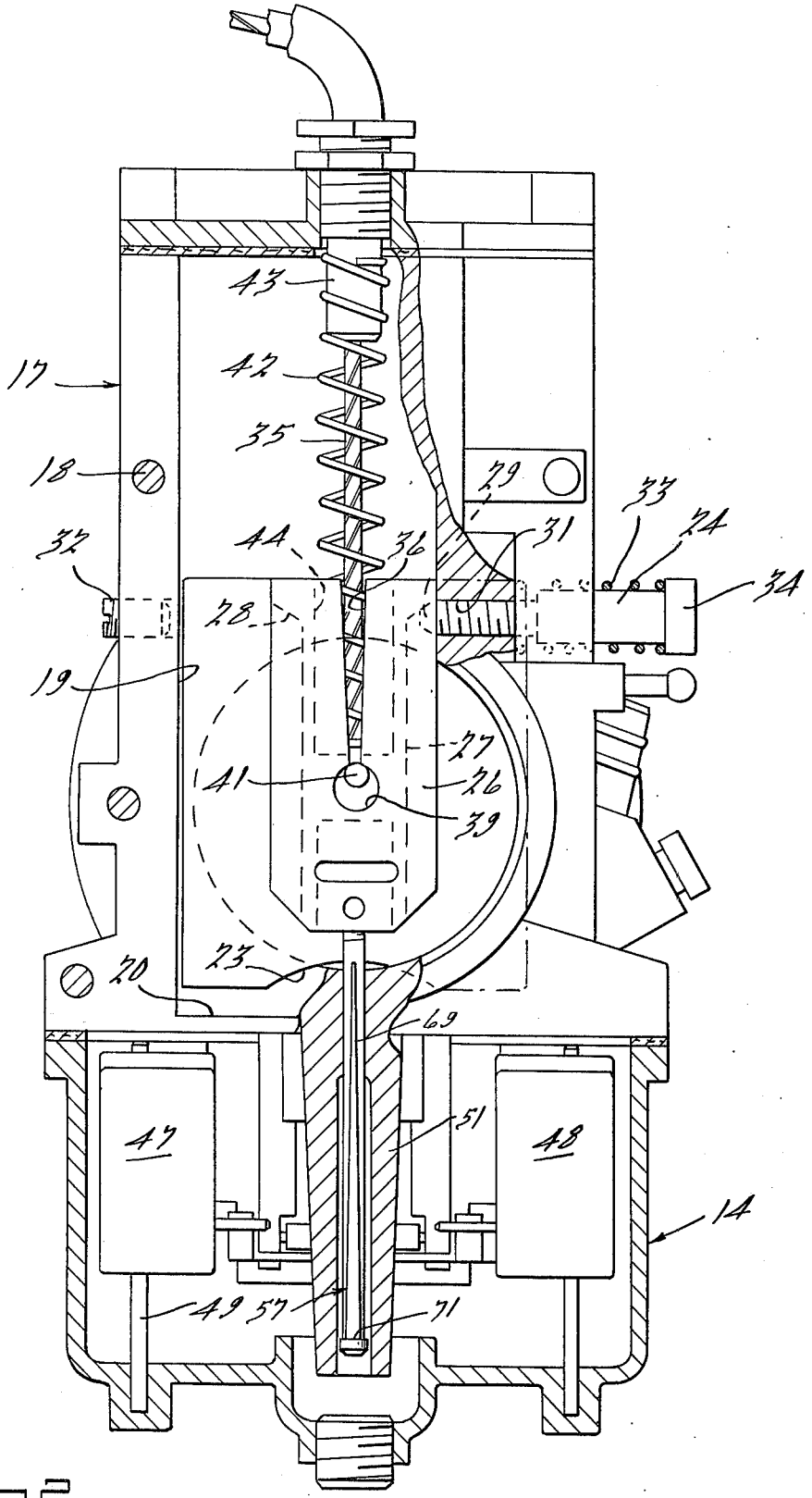
FIG. 2 is a front elevational view looking toward the entrance of the carburetor throat, portions of the carburetor being removed and sectioned for purposes of priority, the slide being shown in an idle position.

Slide supporting portion 17 is provided with a pair of facing side grooves 19 (FIG. 2) and a connecting bottom groove 20 open to the carburetor throat, which is generally indicated at 21. A throttle slide generally indicated at 22 is mounted in these grooves and is vertically adjustable to vary the unblocked portion of throat 21. The width of slide 22 is slightly greater than that of the intermediate portion of throat 21, and the slide has a generally rectangular shape as seen in FIG. 2. A concave arcuate recess 23 is centrally formed along the lower or control edge of slide 22. An idle adjusting screw 24 is threadably mounted in the side of slide supporting portion 17 and limits downward movement of slide 22, thus defining the idle position. This position may be chosen so that a slight gap 25 exists between the central portion of recess 23 and the bottom of throat 21. Alternatively, for purposes such as racing, the setting may be for complete shutoff at idle, with recess 23 within slot 20.

Slide 22 is quite thin but has a central enlargement 26 on its downstream side which extends from the top of the slide toward recess 23. A groove 27 is formed in each side of this enlargement for the reception of the inner end of idle adjusting screw 24, the top 28 of this groove being sloped as seen in FIG. 2 to coact with the adjusting screw.

More particularly, the adjusting screw has a tapered end 29 complementary to top 28 of each groove so that by moving the screw in or out, the idle position may be varied. A threaded aperture 31 is formed in each side of slide supporting portion 17, so that the screw may be mounted on either side of the carburetor, depending on accessibility requirements. The unused aperture may be closed with a threaded plug 32. A helical coil compression spring 33 surrounds the outer unthreaded portion of screw 24 and is held between the head 34 of the screw and slide supporting portion 17. Spring 33 will serve to hold the screw in its adjusted position.

A cable 35 is provided for vertically adjusting slide 22. Enlargement 26 has a recess 36 for this cable. The lower end of recess 36 is enlarged at 39 to receive the enlarged cable end 41. A helical coil compression spring 42 is disposed between cover 13 and slide 22, the upper end of this spring surrounding a guide 43, the lower end being received by a recess 44 in enlargement 26. Spring 42 urges slide 22 downwardly so that its position will be controlled either by cable 35 or idle adjustment screw 24.

Bowl 14 is provided with a fuel inlet passage 45 leading to a float needle valve generally indicated at 46. This valve is controlled by a pair of floats 47 and 48 guided by pins 49 within the bowl. The arrangement is such that floats 47 and 48, when lifted by the rising level of fuel in bowl 14, will close valve 46, thus controlling the level of fuel in the bowl.

A fuel discharge nozzle tube 51 extends downwardly from the lower portion of body 12 into bowl 14. The exterior of tube 51 tapers downwardly from its juncture 52 with the body, and bottom 53 of the tube is disposed within a cup-shaped portion 54 of bowl 14. A relatively wide channel 55 within the tube leads upwardly to a narrow nozzle pin guide passage 56, the latter opening onto and being flush with carburetor throat 21.

A nozzle pin generally indicated at 57 is secured to extension 26 of slide 22 and extends downwardly into nozzle 51. Pin 57 has a threaded upper end 58 mounted in a slide insert 59, the latter being disposed within a bore 61 on the underside of slide extension 26. A substantial clearance is provided between bore 61 and the outer surface of insert 59. The insert is held against lengthwise movement with respect to slide 22 and at the same time supported for limited lateral movement by an O-ring 62. This O-ring is disposed within a groove 63 on the exterior of insert 59 so that it tightly grips the insert. The outer portion of O-ring 62 is disposed in a groove 64 at an intermediate portion of bore 61. Slot 64 is open toward face 37 of enlargement 26, in order to permit assembly of the O-ring and other parts. The width of groove 64 in all directions is sufficient to permit the floating action to take place. A flat portion 65 is provided on threaded portion 58, and a set screw 66 is threadly mounted in insert 59 and adapted to engage the flat portion so as to hold the pin in its screw-adjusted position within the insert. An access hole 67 is provided in slide portion 26 for set screw 66. The position of pin 57 at idle, that is, when slide 22 is in its fully lowered position, will be determined by the rotated position of the pin. This adjustment will normally be made to obtain the desired richness of mixture at idle and low speed settings, and to prevent a power "flat" spot upon acceleration.

Below threaded portion 58, pin 57 has a cylindrical upper portion 68 and a flat taper 69 therebelow extending to a radial shoulder 71 near the bottom. The depth of taper 69 will affect performance at higher speeds, deeper tapers resulting in richer fuel-air mixtures. Raising the pin relative to slide recess 23 will also enrich the mixture at any given slide setting.

The fit between portion 68 of the pin and bore portion 56 is very close, perhaps 0.001 inches or less. In the normal idle position, this cylindrical pin portion is slightly above bore portion 56. For full fuel shutoff in racing applications, however, the cylindrical pin portion may extend slightly into bore portion 56. If slide recess 23 is within groove 20, complete fuel and air shutoff will result. When in idle position, the bottom of pin 57 will be slightly above the bottom 53 of tube 51, there being considerably more tolerance between the pin and bore portion 55 than with bore portion 56. During sudden acceleration, when slide 22 is raised quickly, shoulder 71 may have a pumping action on the fuel within bore portion 55, thus increasing fuel flow to the carburetor throat. The fact that tube 51 is integral with body 12 will minimize vibration and the subsequent fuel pumping action which could lead to undesired variations in air-fuel ratio.

In operation, air will flow into entrance 15 of throat 21 and past the portion of pin 57 which is lifted by slide 22 into the airstream. The movement of air past the pin will cause a zone of reduced pressure adjacent the tapered undersurface 69 serving to draw the fuel from the flow chamber and deliver it to the main air passage in finely divided, atomized particles.

At all settings of slide 22, the area through which air flows will be defined by the lower controlling edge of this slide, including its concave recess 23. The widest part of this opening will thus always remain directly in line with pin 57. Consequently, the maximum volume of air traversing the passage flows directly over and around the pin and is utilized for maximum effect in drawing fuel into the airstream, thoroughly atomizing the fuel as it leaves the pin, and distributing the atomized fuel uniformly in the airstream before reaching the combustion chamber, thus minimizing the possibility of fuel droplets leaving the airstream and condensing on the walls of the fuel passages.

The length and depth of concave recess 23 may be varied depending on the size and requirements of the particular engine. In some cases, the optimum condition may be to have the radius of curvature of recess 23 approximately the same as that of throat 21. However, special conditions may require a shallower and deeper recess.

The choke arrangement of this invention comprises an air passage 72 extending longitudinally alongside body 12 in a boss 73 formed on the side of the body. This air passage has an entrance 74 adjacent flared entrance 15 of throat 21, and leads to a cross passage 75 which enters throat 21 downstream of slide 22. More particularly, a choke cavity 76 extends downwardly through an enlarged portion 77 of body 12 (FIG. 6), passage 72 leading into this cavity and passage 75 leading radially inwardly from the cavity to throat 21.

A fuel inlet tube 78 is formed in bowl 14, and a choke supply tube 79 is carried by body 12 and extends downwardly into tube 78. Tube 79 leads to a passage 81 within body 12 which in turn leads through a passage 82 to a valve seat 83 facing cavity 76. A valve 84 is slidably mounted in cavity 76 and has a stem 85 leading upwardly through a grommet 86. A choke operating lever 87 is pivotally mounted at 88 on a support bracket 89 secured to the top of body 12 (FIG. 1). Lever 87 has a forked member 90 engaging a shoulder 91 at the top of stem 85. A helical compression spring 92 is disposed within cavity 76, its lower end engaging shoulder 93 on valve 84 and its upper end supported by a shoulder 94 on a retainer 95 which is threadably mounted on body portion 77 and on which grommet 86 is mounted. Spring 92 will normally hold valve 84 against valve seat 83, but operation of lever 87 will raise the valve against the action of spring 92, permitting air to rush through the choke cavity. A detent 96 may be provided for a holding lever 87 in its adjusted position. Alternatively, choke stem 85 may be automatically instead of manually controlled.

In operation of the choke mechanism, valve 84 may be opened when the engine is cold or at other times when choking is desired. Cranking of the engine will create suction that will draw air into throat 21 and through choke air passage 72. This in turn will draw fuel from bowl 14 and through tube 79. The fuel will mix with the incoming air in cavity 76, and the air-fuel mixture will pass through passage 75 and enter the downstream side of throat 21.

While it will be apparent that the preferred embodiments of the invention disclosed are well calculated to fulfill the objects above stated, it will be appreciated that the invention is susceptible to modificaton, variation and change without departing from the proper scope or fair meaning of the subjoined claims.

I claim:

1. A carburetor comprising a body with inlet and outlet ends, a throat extending through said body from one end to the other, a throttle slide in said body extending transversely to the throat at an intermediate portion thereof, said slide being movable to vary the unblocked portion of said throat, said slide comprising a thin flat member of substantially rectangular shape having a central enlargement on the downstream face thereof, the slide being thin from said enlargement outwardly to its side edges, the height of said slide being only slightly greater than the height of said throat, said enlargement being in the path of said throat, the lower edge of said slide having a centrally disposed downwardly open concave recess, the bottom of said enlargement being spaced above the upper central portion of said concave recess, a fuel tube extending transversely to said throat and having an opening into said throat concentric with said recess, a pin disposed in said tube and having fuel metering means associated therewith at one side thereof downstream of said slide for regulating flow of fuel from said passage into the stream of air traversing said throat, one end of said pin extending into said tube, means mounting the other end of said pin in said enlargement so that the pin extends downwardly therefrom past said recess, the pin being centrally disposed with respect to the recess whereby the widest portion of said recess is aligned with said pin, the end of said fuel tube adjacent said throat being flush with the throat whereby air may pass through the entire space between said recess and said throat past said pin.

2. A carburetor according to claim 1, the downstream side of said pin being tapered, and means for longitudinally adjusting the position of said pin with respect to said slide, whereby the relationship of said taper to said concave recess may be varied.

3. A carburetor according to claim 1, further provided with guide means on opposite sides of said throat coacting with complementary guide means on said slide to support the slide during said movement, and a bottom groove in said throat receiving said slide control edge.

4. A carburetor according to claim 1, said concave recess having approximately the same radius of curvature as said throat.

5. The carburetor according to claim 1, said slide being of generally rectangular shape, said pin end mounting means comprising a threaded support for said pin within said enlargement, whereby the pin may be longitudinally adjusted with respect to the slide.

6. A carburetor according to claim 1, further provided with means urging said slide towards a closed position, and adjustable stop means for defining the relative positions of said concave recess and throat at said closed position.

* * * * *